United States Patent [19]

Katagi et al.

[11] Patent Number: 4,506,270

[45] Date of Patent: Mar. 19, 1985

[54] REFLECTING MIRROR ANTENNA UNIT WITH DIVERSE CURVATURE

[75] Inventors: Takashi Katagi; Shigeru Makino; Hirokazu Tanaka; Yuji Kobayashi, all of Kanagawa, Japan

[73] Assignee: Mitsubishi Denki Kabushiki Kaisha, Tokyo, Japan

[21] Appl. No.: 440,220

[22] PCT Filed: Dec. 8, 1981

[86] PCT No.: PCT/JP81/00372

§ 371 Date: Oct. 12, 1982

§ 102(e) Date: Oct. 12, 1982

[87] PCT Pub. No.: WO82/02120

PCT Pub. Date: Jun. 24, 1982

[30] Foreign Application Priority Data

Dec. 10, 1980 [JP] Japan ..... 55-174081

[51] Int. Cl.[3] ..... H01Q 15/14

[52] U.S. Cl. ..... 343/914

[58] Field of Search ..... 343/840, 912, 914, 915, 343/916, 781 R, 781 P, 781 CA, 754, 755, 379

[56] References Cited

U.S. PATENT DOCUMENTS 3,521,288 7/1970 Schell ..... 343/781 P 4,090,204 5/1978 Farhat ..... 343/754

FOREIGN PATENT DOCUMENTS 54-27346 3/1979 Japan .

*Primary Examiner*—Eli Lieberman

*Assistant Examiner*—Michael C. Wimer

*Attorney, Agent, or Firm*—Sughrue, Mion, Zinn, Macpeak and Seas

[57] ABSTRACT

In a reflecting mirror antenna unit, the surface of the reflecting mirror is divided into a plurality of parts, and the parts are made different in thickness from one another, for instance, by bonding metal tapes different in thickness thereto, to change the phase distribution on the reflecting mirror, whereby the configuration of the radiation pattern due to the current distribution on the reflecting mirror is readily changed.

2 Claims, 3 Drawing Figures

REFLECTING MIRROR ANTENNA UNIT WITH DIVERSE CURVATURE

BACKGROUND OF THE INVENTION

The present invention relates to a reflecting mirror antenna unit, and is intended to provide a reflecting mirror antenna unit in which a radiation pattern due to the current distribution on the reflecting mirror can be varied readily.

With a conventional antenna unit of the type in which a radio wave radiated by a primary radiator thereof is reflected by a reflecting mirror, it is disadvantageous in that, even if the antenna unit is so designed that for instance a side lobe is low, the side lobe is higher than a desired one for instance because of errors involved in manufacturing the mirror surface. Among these side lobes, one formed in a direction near the bore-sighting axis is often due to the variation of the current distribution which is caused by deformation of the mirror surface. It is difficult to decrease this side lobe.

Heretofore, in order to decrease such a side lobe level, an antenna unit as shown in FIG. 1 is employed. In FIG. 1, reference characters 1*a* and 1*b* designate primary radiators, 2*a* and 2*b* directional couplers, 3 a resistance attenuator, 4 a phase unit and 5 a main reflecting mirror. The antenna unit is intended to eliminate the side lobe which is formed by an antenna system consisting of the main primary radiator 1*a* and the main reflecting mirror according to a method in which the primary radiator 1*b* is added and a part of the signals from the main feeding system, being branched to the directional couplers 2*a* and 2*b*, is fed to the primary radiator 1*b* with suitable phase and amplitude. That is, a particular side lobe can be eliminated by providing a beam which is equal in amplitude to and opposite in phase to the side lobe.

However, the method is disadvantageous in that, when it is required to eliminate a number of side lobes, the arrangement is necessarily intricate as much and accordingly is expensive.

SUMMARY OF THE INVENTION

In view of the above, an object of the present invention is to eliminate the above described drawbacks accompanying the prior art antenna unit, and the object is accomplished by the provision of an antenna unit in which the surface of a reflecting mirror is divided into a plurality of parts, and the parts are made different in thickness from one another, for instance, by bonding metal tapes suitable in thickness thereto, so as to change the phase distribution on the reflecting surface, whereby the configuration of the radiation pattern due to the current distribution on the reflecting mirror is readily changed.

BRIEF DESCRIPTION OF THE DRAWINGS

In the accompanying drawings,

FIG. 2*a* is a diagram showing the surface of a reflecting mirror, which has been divided into plural parts, and FIG. 2*b* is a diagram showing the parts of the reflecting mirror surface, which are made different in thickness from each other.

DESCRIPTION OF THE PREFERRED EMBODIMENT

An embodiment of the present invention, in which the level of a side lobe in a particular direction is decreased, will be described with reference to the accompanying drawings.

Figure 1:
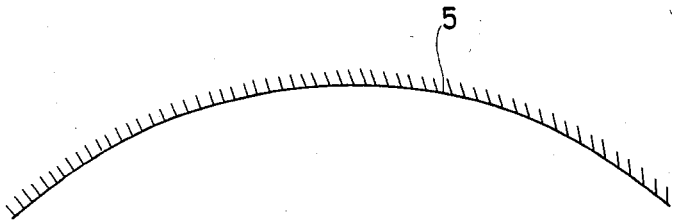
FIG. 1 PRIOR ART
FIG. 1 is an explanatory diagram illustrating the arrangement of a conventional reflecting mirror antenna unit and FIGS. 2*a* and 2*b* illustrate one preferred embodiment of the present invention. More specifically.
Figure 1:
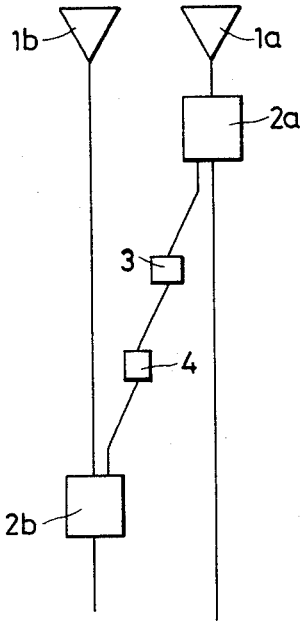
FIG. 1 PRIOR ART
Figure 2:
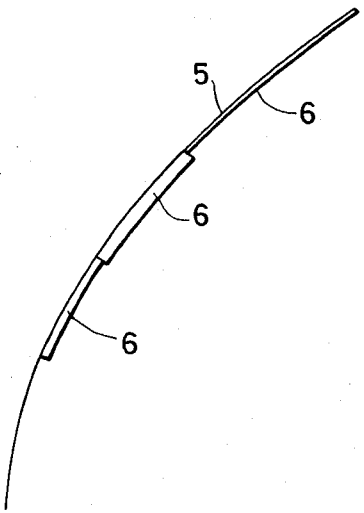
Figure 2:
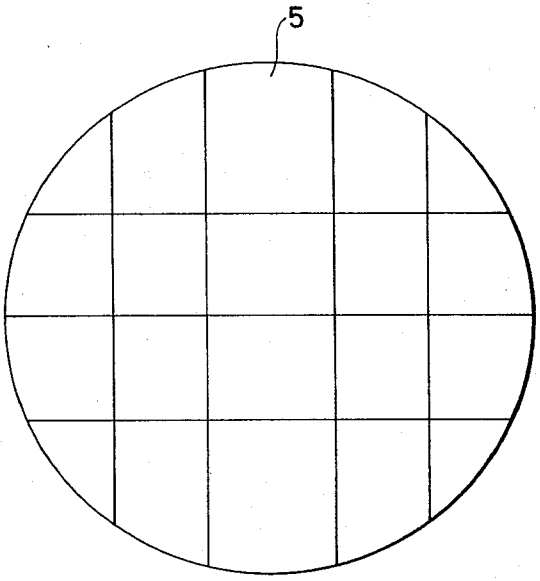

In the following preferred embodiment, a main reflecting mirror is used to decrease a radiation field $\dot{E}$ ($\textcircled{H}$, $\Phi$) in a direction $\textcircled{H}$, $\Phi$. In FIG. 2*b*, reference numeral 5 designates a main reflecting mirror and reference numerals 6*a*, 6*b* and 6*c* designate metal tapes different in thickness from one another, which are bonded to the surface of the main reflecting mirror 5. When the main reflecting mirror 5 is divided into N parts as shown in FIG. 2*a* and the radiation field in a direction $\textcircled{H}$, $\Phi$ each of these parts is represented by $\dot{E}_n$ ($\textcircled{H}$, $\Phi$), then the following expression (1) is obtained.

$$\dot{E}(\textcircled{H}, \Phi) = \sum_{n=1}^{N} \dot{e}_n(\textcircled{H}, \Phi) \tag{1}$$

Furthermore, $e_n$ can be represented by a phase $\phi_n$ and an amplitude $|\dot{e}_n|$, that is, $$\dot{e}_n = |\dot{e}_n| e^{j\phi_n} \tag{2}$$

In this connection $E_0$ is defined as follows, $$E_0 = \sum_{n=1}^{N} |\dot{e}_n| = \sum_{n=1}^{N} \dot{e}_n e^{-j\phi_n} \tag{3}$$

The data $E_0$ is maximum in the direction $\textcircled{H}$, $\Phi$, but it scarcely has influences in the other directions. Accordingly, in order that the field in the direction $\textcircled{H}$, $\Phi$ is $E_1$ as desired and no influence is given in the other directions, a value $\dot{\alpha}$ should be so selected as to meet the following condition (4) and accordingly condition (5):

$$\dot{E} + \dot{\alpha}E_0 = \dot{E}_1 \tag{4}$$

$$\dot{\alpha} = \frac{\dot{E}_1 - \dot{E}}{E_0} = |\dot{\alpha}| e^{j\phi_\alpha} \tag{5}$$

In this case, $$\dot{E}_1 = \sum_{n=1}^{N} \dot{e}_n + \dot{\alpha} \sum_{n=1}^{N} \dot{e}_n e^{-j\phi_n} = \sum_{n=1}^{N} \dot{e}_n (1 + \dot{\alpha} e^{-j\phi_n}) \tag{6}$$

Therefore, the amplitude and phase of each of the divided mirror surfaces should be changed by $(1+\dot{\alpha} e^{-j\phi_n})$. However, in the reflecting mirror antenna unit, the amplitude cannot be changed. Accordingly, with respect to the phase only, $$1 + \dot{\alpha} e^{-j\phi_n} = \sqrt{1 + |\dot{\alpha}|^2 + 2|\dot{\alpha}|\cos(\Phi_n - \Phi_\alpha)}\; e^{-j\phi_n'} \tag{7}$$

-continued $$\Phi_n' = \tan^{-1}\frac{|\dot{\alpha}|\sin(\phi_n - \phi_\alpha)}{1 + |\dot{\alpha}|\cos(\phi_n - \phi_\alpha)} \quad (8)$$

Thus, a metal tape having a thickness $t_n$ corresponding to the phase $\Phi_n$, should be bonded to each of the divided mirror surfaces as shown in FIG. 2*b*.

The data $t_n$ is defined by the following expression (9):

$$t_n = \frac{1}{2k\cos\theta_n}\cdot\Phi_n' \quad (9)$$

where k is the wave number, and $\theta_n$ is the incident angle.

The method has been described with reference to the case where the level of a side lobe in a particular direction is decreased. However, it can be readily understood that the method is effectively applied to decrease the levels of a plurality of side lobes, because the method scarcely gives influence in the other directions.

While the invention has been described with reference to the case where the level of a side lobe is decreased, it should be noted that the invention is not limited thereto or thereby. That is, the current distribution on the mirror surface can be changed. Therefore, the invention is effective in changing the configuration of a beam in a beam antenna unit.

While the embodiment of the invention has been described with reference to the case where the configuration of a radiation pattern is changed by the main reflecting mirror, the invention is not limited thereto or thereby. It is obvious that, in the case of a reflecting mirror antenna unit with an auxiliary reflecting mirror, the same effect can be obtained according to a method in which the auxiliary reflecting mirror is divided in N parts, and the radiation field after radio waves from these parts have been reflected by the main reflecting mirror are represented by $\dot{e}_n$.

What is claimed is:

1. An antenna unit with a reflecting mirror characterized in that the surface of a reflecting mirror is divided into a plurality of parts and the parts are made different in thickness by $t_n$ from one another, the $t_n$ being defined by $$t_n = \frac{1}{2k_{cos}\theta_n}\cdot\Phi_n'$$

where k is the wave number, $\theta n$ is the incident angle of a radio wave to said reflecting mirror and $\Phi_n'$ is an amount of phase necessary for varying a particular radiation pattern, which is defined by $$\Phi_n' = \tan^{-1}\frac{|\dot{\alpha}|\sin(\phi_n - \phi_3)}{1 + |\dot{\alpha}|\cos(\phi_n - \phi_2)}$$

in which $\alpha$ is a complex constant having a phase term and an amplitude term, the $\alpha$ being determined as $\alpha = -(E_1 - E)/E_0 = |\alpha| e^{j\phi a}$ so as to make an electric field in a direction ($\theta$, $\Phi$) at a desired value, in the expression $\alpha$, E being a radiation field in a direction ($\theta$, $\Phi$), $E_1$ being a desired radiation field in the direction ($\theta$, $\Phi$), $E_0$ being a radiation field maximum in the ($\theta$, $\Phi$), $\phi_n$ being a phase of a radiation field $e_n(\theta, \Phi)$ in the direction ($\theta$, $\Phi$) of the n-th part of said divided reflecting mirror and $\phi_a$ being a phase of said complex constant $\alpha$.

2. The antenna unit as claimed in claim 1 wherein said plural parts are made different in thickness from one another by bonding metal tapes on the surface of said reflecting mirror.

* * * * *